US008542865B2

(12) United States Patent
O'neill

(10) Patent No.: US 8,542,865 B2
(45) Date of Patent: Sep. 24, 2013

(54) TRANSDUCER MOTOR STRUCTURE AND INSIDE-ONLY VOICE COIL FOR USE IN LOUDSPEAKERS

(76) Inventor: Robert M. O'neill, Oxford, MS (US)

( * ) Notice: Subject to any disclaimer, the term of this patent is extended or adjusted under 35 U.S.C. 154(b) by 861 days.

(21) Appl. No.: 12/530,411

(22) PCT Filed: Mar. 10, 2008

(86) PCT No.: PCT/US2008/003124

§ 371 (c)(1),
(2), (4) Date: Feb. 27, 2010

(87) PCT Pub. No.: WO2008/112176

PCT Pub. Date: Sep. 18, 2008

(65) Prior Publication Data

US 2010/0150392 A1 Jun. 17, 2010

Related U.S. Application Data

(60) Provisional application No. 60/905,844, filed on Mar. 9, 2007.

(51) Int. Cl.
*H04R 1/00* (2006.01)

(52) U.S. Cl.
USPC ..... 381/410; 381/400; 381/420; 381/403; 381/405; 381/406; 381/407; 381/409; 381/421; 381/423; 29/605; 29/606; 29/594; 29/595

(58) Field of Classification Search
None
See application file for complete search history.

(56) References Cited

U.S. PATENT DOCUMENTS

| | | | | |
|---|---|---|---|---|
| 7,006,654 | B2 * | 2/2006 | Stiles et al. | 381/412 |
| 2006/0088184 | A1 * | 4/2006 | Ohashi et al. | 381/430 |
| 2007/0183620 | A1 * | 8/2007 | Stiles et al. | 381/401 |

* cited by examiner

*Primary Examiner* — Duc Nguyen
*Assistant Examiner* — Taunya McCarty
(74) *Attorney, Agent, or Firm* — J. A. McKinney & Assoc., LLC

(57) ABSTRACT

An electromechanical transducer 180, motor structure 200 and voice coil winding support structure or bobbin 210 are configured to protect and transport heat away from a voice coil 220 which is would solely within the interior of bobbin 210 and configured for reciprocating movement in close proximity to an extended cooling pole piece 204. A compact, economical and efficient adaptation of a pancake style motor includes generous volume for a powerful magnet 208, while providing an extended, linear range of excursion and continuous cooling for the generously overhung voice coil 220.

6 Claims, 17 Drawing Sheets

INSIDE ONLY TECHNOLOGY

POT CORE STYLE

"PANCAKE" STYLE

Typical Voice Coil Styles
Voice Coil "Bobbin" or "Former"

Inside/Outside
Pancake Design

Inside/Outside
Pot Core

INSIDE ONLY TECHNOLOGY

18" I/O voice coil assembly
Former material to be glass reinforced
Fiber, voice coil adhesive system to be
rated 200C.

Voice coil wire to be copper clad aluminum
Voice coil cross section to be rectangular
Wire dimensions to be 0.35mm x 0.70mm
W/L=26mm DC Resistance to be 5.1 ohms nominal
Wire insulation to be 200C FIG. 16A
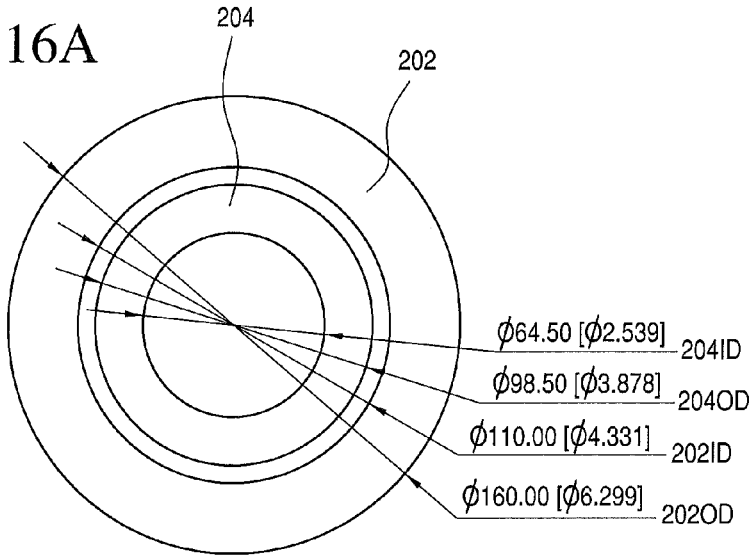
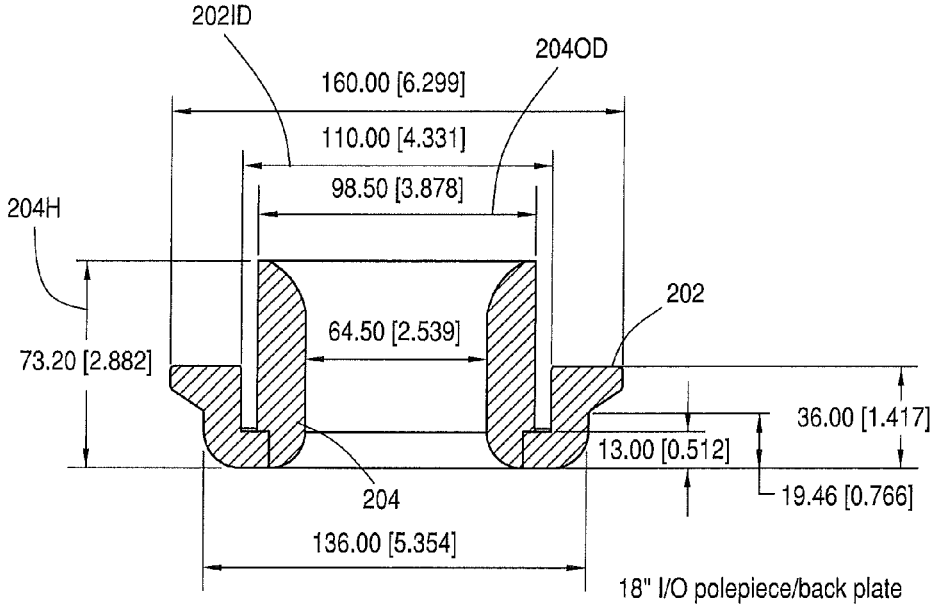
18" I/O polepiece/back plate material to be 1010 steel or better.
Finish to be EIP or zinc with clear chronate
FIG. 16B

TRANSDUCER MOTOR STRUCTURE AND INSIDE-ONLY VOICE COIL FOR USE IN LOUDSPEAKERS

PRIORITY CLAIMS AND REFERENCE TO RELATED APPLICATIONS

This is a Continuation application which claims priority under 35 U.S.C. 120 and 35 U.S.C. 111(a) as the U.S. National Phase under 35 USC 371 of PCT/US2008/003124, filed Mar. 10, 2008; published, in English, as WO 2008/112176 on Sep. 18, 2008 and also claims priority to U.S. provisional patent application 60/905,844 filed Mar. 9, 2007, the entire disclosures of which are expressly incorporated herein by reference.

BACKGROUND OF THE INVENTION

1. Technical Field of the Invention

The present invention relates to electromechanical transducers and motor structures, and, more particularly, to loudspeaker driver voice coil winding support structures and methods for configuring voice coils for use in loudspeaker applications.

2. Description of the Background Art

Recent market emphasis on long excursion, high power dissipation loudspeakers (e.g., low frequency drivers or woofers) has challenged manufacturers to make products which will withstand previously unimaginable levels of abuse. DB drag races and other forms of loudness-level competition have created markets for amplifiers and loudspeakers dissipating several kilowatts (kW) for extended periods of time. Such products have been incorporated in auto sound systems generating acoustic outputs exceeding one hundred seventy decibels (170 dB) before failing.

Loudspeakers have well understood limitations. In particular, high power signals drive a speaker's diaphragm or cone into extreme excursions and can cause the (usually pistonic) motion of the diaphragm to become mis-aligned when driven by more challenging audio signals. Typical prior art woofers utilize circular baskets supporting frustoconical driver diaphragms having a circular peripheral edge carrying an annular surround or suspension, as shown in FIG. 1*a*.

In order to better explain the present invention, a conventional loudspeaker driver 100 is shown and some nomenclature used by those having skill in the art will be reviewed. In a transducer or loudspeaker apparatus for converting electric signals to acoustic energy, a cone type speaker unit or driver has conventionally been used. FIG. 1A shows an example of such a speaker. Referring to FIG. 1A, a cylindrical voice coil bobbin 103 has a conductive voice coil 102 wound around its outer circumferential wall and is affixed to the center of a frusto-conical diaphragm 101 or cone. The diaphragm 101 and the voice coil bobbin 103 are fixed to an inner peripheral edge of an annular or ring-shaped surround or edge 108 and to an annular damper or "spider" 109 having a selected compliance and stiffness. The outer peripheral ends of the surround 108 and the spider 109 are fixed to a rigid supportive frame or basket 112 that also carries a three-piece magnetic circuit 107, so that the frame 112 supports the diaphragm 101 and voice coil bobbin 103, which are pistonically movable within the frame along the central axis of bobbin 103. A centered "dust" cap 113 is fixed on the diaphragm 101 to cover the hole at the center of the diaphragm 101, and moves integrally with the diaphragm 101.

The edge 108 and damper 109 support the voice coil 102 and voice coil bobbin 103 at respective predetermined positions in a magnetic gap of the magnetic circuit 107, which is constituted of a magnet 104, a plate 105, a pole yoke 106 including a central, axially symmetrical pole piece 115. With this structure, the diaphragm 101 is elastically supported without contacting the magnetic circuit 107 and can vibrate like a piston in the axial direction within a predetermined amplitude range.

The first and second ends or leads of the voice coil 102 are connected to the respective ends of first and second conductive lead wires 111 which are also connected to first and second terminals 110 carried on frame 112. When an alternating electric current corresponding to a desired acoustic signal is supplied at terminals 110 to voice coil 102 through the lead wires 111, the voice coil 102 responds to a corresponding electro-motive force and so is driven axially in the magnetic gap of the magnetic circuit 107 along the piston vibration direction of the diaphragm 101. As a result, the diaphragm 101 vibrates together with the voice coil 102 and voice coil bobbin 103, and converts the electric signals to acoustic energy, thereby producing acoustic waves such as music or other sounds.

Returning to the specifics of the conventional speaker's voice coil gap, the magnetic field or "B" field acting on the voice coil 102 is generated in the annular magnet 104, and the lines of flux pass from magnet 104, through front plate 105, across the annular magnetic gap to the peripheral upper edge of pole piece 115, down through pole piece 115, radially out through yoke 106 and then back into magnet 104, forming a closed loop of magnetic flux. The field strength in the magnetic gap is preferably very high, and so the radial distance across the magnetic gap is something most speaker designers seek to minimize.

Narrow and efficient magnetic gaps create other problems, however, because the close mechanical tolerances of a tight magnetic gap require the outer winding surfaces of voice coil 102 to reciprocate in and out in very close proximity to the inner edge of top plate 105. If, during extreme excursions or when expanding due to resistance heating, coil 102 should rub or abrade against the inner edge of top plate 105, then voice coil 102 destroys itself and the loudspeaker fails catastrophically.

Loudspeaker or woofer failure can be often attributed to these types of thermal or mechanical overloading problems. Substantial amounts of power are required to provide competition-winning sound pressure levels, and signals having such power require very large current flow through voice coil conductors, thus generating substantial amounts of heat and driving the woofer's diaphragm to extreme excursions. Those extreme excursions generate extreme mechanical loads on the diaphragm and its supportive suspension. In competitions, operators seek the loudest possible playback and often overdrive the loudspeaker drivers, causing voice coils to burn out or open circuit.

Returning to first principles, the function of a loudspeaker is to convert electrical energy to an analogous acoustical energy. This conversion process takes place in two steps. The first step is the conversion from electrical energy to mechanical energy. The second step is a conversion from mechanical energy to acoustical energy. The first step consists of generating a mechanical displacement proportional to the electrical input signal. The second step consists of coupling the mechanical displacement of the system to the surrounding air via some mechanism, such as forced movement of diaphragm 101.

The class of loudspeakers known as electro-dynamic employs a combination of permanent magnet (e.g., 104) and electro magnet to produce the conversion of electrical to mechanical energy.

The permanent magnetic structure in this type of loudspeaker (e.g., 104) utilizes a permanent magnetic material, such as neodymium iron boron, aluminum nickel cobalt, or other rare earth or ceramic materials, that is placed in a "magnetic circuit" consisting of a plate of low carbon steel (e.g., 105) on the north magnetic pole of the permanent magnet and another plate of low carbon steel (e.g., 106) on the south magnetic pole of the permanent magnet. Either the plate on the north magnetic pole or the plate on the south magnetic pole is shaped to provide a small magnetic gap. The magnetic gap is usually annular but need not necessarily be of an annular geometry to be functional. The "magnetic gap" then has a high magnetic field strength. The low carbon steel plates act to concentrate the magnetic field in that volume of space known as the magnetic gap.

The electro magnet portion of the transducer is provided by voice coil 102 which consists of a coiled length of electrical conductor suspended in that magnetic gap. When a time varying electrical current flows through the conductor a magnetic field is produced around the wire and that magnetic field is proportional to the magnitude of the electrical current flowing through the wire in the voice coil. If the permanent magnetic gap has an annular geometry then the electro magnet coil may be immersed into the permanent magnetic gap. This gives rise to a force of interaction between the permanent magnetic field and the electro-magnetic field. This force is known as the Lorentz force and is shown in algebraic form as:

$$F=BLi \tag{1}$$

where F is the force of interaction between the two magnetic fields. B is the magnitude of the permanent magnetic field and L is the length of wire immersed in the permanent magnetic field and associated with the coil. In this equation, "i" is the magnitude of the electrical current flowing thru the voice coil's wire.

The force of interaction between the permanent magnetic field and the electro-magnetic, or coil, will produce an acceleration in accordance with Newton's laws of motion.

The motor structure 107 shown in FIG. 1A is typical for inexpensive loudspeaker drivers with cone diaphragms, such as woofers. Other types of motor structures are also available in the prior art, and in each of the following examples, the basket and diaphragm are omitted, to highlight differences in the motor structures.

FIG. 1B is another magnetic circuit 120 known as a "Pot Core" style. The permanent magnetic material 122 (shown crosshatched) supports a piece of soft, low carbon steel known as a Pole Tip 126 and the top is along the magnetic axis of the permanent magnet. The low carbon steel "return path" 124 is located on the opposite side from pole tip 126 and is also on the magnetic axis of the permanent magnet 122. The return path 124 is formed to produce a Magnetic Gap 130 between the topmost inside edge of the pot and the outer peripheral edge of the pole tip 126. The electro-magnet or voice coil 128 is wound around the exterior wall of a cylindrical bobbin or voice coil former and is installed in a position immersed in the permanent magnetic gap 130.

Another common permanent magnet structure geometry is shown in FIG. 2. This style is sometimes referred to as a "pancake" style permanent magnetic structure 132 and it performs an identical function to the pot core style in that the low carbon steel return path 134 and front plate 136 still act to form an annular magnetic gap 139. The voice coil 138 on bobbin 138 is then immersed in the magnetic gap 139 and the result is a force of interaction between the electro-magnetic voice coil and the field from permanent magnet 133.

In the exemplary structures of FIGS. 1A, 1B and 2, the force of interaction will produce a physical displacement of the voice coil. This physical displacement will be a function of the polarity of the permanent magnetic field and the polarity of the time varying electrical current flowing thru the voice coil. The direction of the voice coil displacement will be either up or down along an axis 140 as shown in FIG. 3.

The ability of the loudspeaker to convert electrical signals to proportional mechanical displacements and subsequently to acoustical energy is often referred to as the conversion efficiency of the transducer, or loudspeaker (e.g., 100). The conversion efficiency is proportional to Lorentz force as well as the total moving mass of the loudspeaker, including voice coil, cone, dust cap, and all parts of the transducer that move relative to the permanent magnet structure and frame.

The efficiency of loudspeakers, like all transducers, can be rated as a percentage of the input power to the output power. Typical loudspeakers can range from less than 1% efficient to over 30%. The conversion efficiencies approaching 30% are for a specific type of loudspeaker referred to as compression driver. Typical (non compression driver) loudspeakers range from 1% to 5% efficiency but can be lower or higher as well. These efficiency levels relate the ratio of the electrical input to the acoustic output. As an example, 100 electrical watts of power are typically converted to 3 to 4 watts of acoustic power for a 3% to 4% efficient loudspeaker. The remaining electrical power is converted to heat.

Loudspeaker voice coils can be heated to temperatures of over 450 F degrees (232° C.). These heat levels are extreme and can produce device failure due to degradation of the adhesive systems used to bond the voice coil to its carrier as well as the adhesives used to bond each turn to the next on the voice coil itself. In addition to device failure, the voice coil's direct current ("DC") resistance is also affected by heat. Every alloy of conductor has a Temperature Coefficient of Resistance. This coefficient relates the temperature of the conductor to the DC resistance of the conductor. As the temperature increases, the DC resistance of the conductor also increases. As the DC resistance increases, the current flow thru the conductor decreases and is described by Ohms law, $$V=I/R \tag{2}$$

where V is the applied voltage across the voice coil, I is the current flow thru the voice coil and R is the voice coil's DC resistance. As mentioned earlier, the force of interaction between the permanent magnet and the electro-magnet (the voice coil) is proportional to the current flow thru the coil. If the DC resistance of the voice coil is raised due to heating, then the current draw reduces and, as a consequence, the Lorentz force is reduced.

The change in Lorentz force as a function of DC resistance change from heating is referred to as Power Compression. As the electrical power applied to the voice coil increases, the temperature of the voice coil increases. This increase in voice coil temperature increases the DC resistance and will reduce the current flow thru the voice coil. As the Lorentz force decreases due to reduced current flow the overall loudspeaker conversion efficiency is reduced.

It is desirable to minimize the heat rise associated with current flowing through the voice coil. Technical reviews of the heat produced by voice coils and subsequent performance alterations can be found in various professional journals. "Heat Dissipation and Power Compression in Loudspeaker", Douglas Button, J. Audio Eng. Soc., Vol. 40, No. 1/2 1992, and "heat Transfer Mechanisms in Loudspeakers: Analysis, Measurement, and Design", Clifford a. Henricksen, J. Audio Eng. Soc., Vol 35, No. 10, 1987 are typical examples of theoretical analysis and measurement of the thermal effects of loudspeaker voice coils.

A loudspeaker voice coil is comprised of a length of electrical conductor, typically copper, aluminum or some other alloy. The wire is wound into the shape of a coil whose dimensions are compatible with the dimensions of the permanent magnet gap. The coil is typically wound around or onto a light stiff cylinder known as a "bobbin" or "former". This bobbin acts to support the voice coil and at its upper end serves as a location to bond the diaphragm, or cone. The bobbin material may be made from a polymer, heat resistant fabric, fiberglass prepreg, or metals such as aluminum. With the exception of an aluminum bobbin, most of the former or bobbin materials also act as a thermal insulator and, as a result, the majority of the heat generated by the voice coil can only be effectively dissipated toward that portion of the voice coil away from bobbin. In the case of an aluminum bobbin, the material itself can act as a good thermal path but the material is electrically conductive and the electrically conductive nature of the material allows "eddy currents" to be generated in the bobbin. These eddy currents are a secondary source of heat generation and they also produce magnetic fields that are of opposite polarity and will act to modulate, distort and mitigate the primary electro-magnetic field. For this reason aluminum or other electrically conductive bobbins are rarely used in modern loudspeakers.

FIGS. 4*a*-4*c* illustrate three typical voice coil/bobbin configurations. The voice coil wire may be rectangular (102*a*), round (102*b*), square, or any other geometry. Historically, voice coils have been wound upon the outside surface of a cylindrical bobbin 103. Recently, voice coils have been wound on both the outside and inside surface as shown in FIG. 4*c*, and these are referred to as "inside/outside" voice coils, 102*c*-102*d*.

The rectangular single layer coil 102*a* offers excellent cooling except for the area where the bobbin 103 is located. The round wire multi layer coil 102*b* consists of 2 or more layers of round cross section wire. Because each layer of wire is surrounded by the wire insulator it will not cool as well as the single layer voice coil construction. Multi layer voice coils also have more turns than an equivalent single layer construction and, as a result, exhibit higher inductance which will affect the transducer's amplitude response at higher frequencies.

The "inside/outside" voice coil construction of FIG. 4*c* seeks to improve multi layer cooling by locating one coil layer 102*c* upon the outside of the bobbin 103 and the second layer 102*d* on the inside surface of the bobbin 103. This approach will offer improved cooling when compared to the multi layer "outside only" construction but still suffers from higher inductance as compared to the single layer design of FIG. 4*a*.

Loudspeaker voice coil heating and cooling are affected by several factors; traditional heat transfer analysis describes conduction, convection and radiation. One factor is heat transfer thru the magnetic gap to the surrounding low carbon steel return path.

FIG. 5 shows a pot core motor 120 with the magnetic gap area 130 enlarged for clarity. The voice coil 128 and bobbin 127 are "immersed" in the magnetic gap 130 which is defined by the inside diameter of the pot core 124 and the outside diameter and height of the pole tip 126. The vertical height of the voice coil 128 is made longer than the height of the magnetic gap 130 in order to provide for a constant Lorentz force versus displacement. (i.e., for reasonable displacements a constant length of wire in the magnetic gap will produce a constant Lorentz force). The exact vertical height of the voice coil is a design parameter and will be a function of the desired linear displacement limits of the loudspeaker.

FIG. 6 also represents an enlargement of FIG. 5, and shows voice coil bobbin 127 shaded in black. The zone or area to the inside, between the inside diameter of the bobbin 127 and the outside diameter of the pole tip 126 represent a good path for heat transfer except that the bobbin 127 is usually made from a thermal insulator. The voice coil 128 in this drawing is a single layer rectangular wire coil. The zone or area of good conduction 130H is shown shaded with hi-to-low diagonal lines and is a good heat transfer path. 130H is the area where the outside portion of the voice coil 128 is in close proximity to the inside diameter of the pot core 124. The area shown above represents a zone or area of poor heat transfer 130C. The voice coil wire that extends above the pot core height is not in close proximity to a portion of high thermal capacitance. The upper segment of voice coil 128 proximate to area 130C will be hotter than that the lower portion of the voice coil that is in close proximity to the pot core 124.

A common solution to the problem highlighted in FIG. 6 is shown in FIG. 7. It can be seen that a good solution is to extent the height of the pot core's outer peripheral vertical wall 124T to extend upwardly beyond the vertical height of the voice coil 128. In this implementation, the voice coil 128, regardless of vertical displacement, is always in close proximity to the inside diameter of the pot core 124T. The magnetic gap is essentially unchanged and can actually be made more symmetric about the horizontal central plane line of the pole tip 126. The tall pot core's vertical height now extends beyond the rest position of the voice coil and in fact can be made high enough to provide good conduction for large vertical displacements or excursions. For this design to be successful the voice coil suspension elements (e.g., spider 109) must be spaced high enough on the bobbin 127 to prevent the underside of the suspension from physically hitting the top of the pot core. This technique is very effective in providing good thermal dissipation.

Pot core structures (e.g., 120) are very efficient magnetically but suffer from a basic geometric flaw. If high Lorentz forces are required, a large permanent magnetic field is required in the magnetic gap 130. A pot core design does not easily allow for the permanent magnet material to be of a large cross sectional area. The permanent magnet can be made larger in diameter but expensive and large additions of return steel are required to "neck down" the large magnet cross section to accommodate the vertical sidewall thickness at the peripheral edge of the pole tip 126. (This technique was used frequently with ALNICO permanent magnets). Modern, ultra high energy product permanent magnets, such as Neodymium Iron Boron must be relatively thin in their magnetic axis and this typically dictates using the geometry shown in FIG. 1B.

A good solution for increasing the permanent magnetic field is to use a "pancake" design similar in some ways to that shown in FIG. 2. The "pancake" geometry allows the permanent magnet 133 cross section to be as large as necessary or as large as manufacturing methods permit. FIG. 8 is an enlarged view of a pancake design and illustrates the basic design concept. In this view, the voice coil 138 is shown vertically centered in the magnetic gap. The magnetic gap is defined by the outside diameter (or outer peripheral sidewall) of the pole piece and the inside diameter and vertical height (or inner peripheral sidewall) of the front plate 136. The vertical height of the voice coil 138 extends both above and below the vertical height of the front plate 136 and allows a relatively constant Lorentz force versus displacement as long as the displacement "0" to peak value is within the expression:

$$(\text{voice coil vertical height} - \text{front plate vertical height})/2 \quad (3)$$

The sections of the voice coil that extend beyond the vertical height of the front plate are referred to as coil "overhang". The portions of the coil the extend beyond, or over hang, the vertical height of the front plate 136 will suffer from poor thermal transfer. Just like the case represented in FIG. 6, for the pot core geometry, the coil sections that extend beyond the vertical height of the front plate will not be as cool as the coil segment closest to the inside diameter of the front plate. The geometry of the pancake design is fundamentally different than that of the pot core design. FIG. 7 shows the vertical extension of the tall pot core height 124T and the associated additional thermal conduction. The physical height of the magnetic gap is maintained in FIG. 7 because the pole tip thickness defines the gap height.

Because the voice coil bobbin is a thermal insulator, the most effective conduction path still exists on the outside of the voice coil. To improve cooling in the pancake design, the front plate thickness must be increased. Increasing this thickness, however, now modifies the magnetic gap and will produce an asymmetrical distribution of magnetic flux. This asymmetry will produce an asymmetrical Lorentz force that varies with voice coil displacement.

As shown in FIG. 4C, another type of voice coil construction is the "inside/outside" style. This is shown in FIGS. 9*a* and 9*b*, where it can be seen that in either design there are compromises in the transfer of heat. The inside/outside pot core design of FIG. 9*a* suffers in that the inside portion of the voice coil 102D still presents cross sectional area both above and below the vertical height of the pole tip 126 where heat transfer is less than optimal. The pancake design of FIG. 9*b* has the same condition, except now the area of poor conduction is associated with the outside windings 102C where the coil is "overhanging" both above and below the vertical height of the front plate 136.

Prior art designs have attempted to deal with the thermal issues associated with the pancake design while still maintaining the magnetic gap symmetry but adding thermally conductive heat sinks 150, 152 above, below, and sometimes both above and below the front plate 136 as shown in FIG. 10. The shaded portions of FIG. 10 represent sections of thermally conductive material, typically aluminum both above and below the front plate. These are effective in transferring heat, although the low electrical resistance associated with aluminum will allow large eddy currents to be induced into the "heat sinks" 150, 152 and become a secondary source of heat generation. In addition to the secondary generation of heat, these additional parts 150, 152 represent additional expense and complexity. It is also not possible to accurately locate these parts and make them radially concentric with the front plate's inner peripheral edge without adding a machining step to the assembly operation after all of the parts have been assembled but prior to the application of a protective coating (i.e. electroplating, e-coating etc). This secondary machining operation is the only effective way to accurately insure that the inside diameter of the upper and lower heat sink pieces 150, 152 match the inside diameter of the front plate 136. It is typical to make the heat sink diameters of a larger inside diameter to avoid mechanical interference with the voice coil 102A. Increasing this inside diameter reduces the proximity of the heat sink to the outside diameter of the voice coil and reduces heat transfer from the coil into the heat sink.

There is a need, therefore, for a loudspeaker motor structure and a voice coil adapted to withstand the abuse encountered in modern high-power long-excursion loudspeaker applications.

SUMMARY OF THE INVENTION

There has been summarized above, rather broadly, the prior art that is related to the present invention in order that the context of the present invention may be better understood and appreciated. In this regard, it is instructive to also consider the objects and advantages of the present invention.

It is a primary object of the present invention to overcome the above mentioned difficulties by providing a transducer motor structure and voice coil adapted to withstand high-excursion, high power loudspeaker applications.

Another object of the present invention is to provide a loudspeaker motor structure economically configured to conduct, convect and radiate heat energy away from the critical voice coil.

Another object of the present invention is to provide a loudspeaker motor structure configured to withstand high thermal loads and overcome the prior art's voice-coil rubbing induced failure mechanisms.

The aforesaid objects are achieved individually and in combination, and it is not intended that the present invention be construed as requiring two or more of the objects to be combined.

In accordance with the method and structure of the present invention, a new loudspeaker motor structure includes electrically conductive voice coil wire wound solely and entirely within a (preferably) cylindrical bobbin or former to provide a voice coil having a smooth, tough resilient cylindrical exterior sidewall surface that is ideally well suited to be positioned very close to the driver motor's thermally conductive front plate, near the front plate's inwardly facing surface which defines the magnetic gap. The voice coil's conductive wire is wound only within the voice coil bobbin's cylindrical interior or inside surface and so can never rub against or be interfered with by the front plate, even when expanding due to thermal expansion.

Referred to as "inside only" technology, this novel approach offers the same level of heat transfer that the pot core design offers but allows the permanent magnet's area and volume to generate high permanent magnetic field strength with a specially adapted pancake style design.

The loudspeaker driver motor structure of the present invention has its voice coil wound on the inside of the bobbin proximate the pole piece portions of the low carbon steel magnetic return path which are specially configured to extend forward or toward the diaphragm, providing a central pole piece that projects forwardly and is taller than in the prior art. The central or axial pole piece's height, in a preferred embodiment, will always be higher than the maximum physical displacement, or excursion, of the moving driver's voice coil assembly, thereby providing good thermal transfer from the voice coil to the pole piece regardless of the voice coil's displacement or excursion. The geometry of the present invention does not alter the permanent magnet gap's volume or symmetry. A disadvantage of the tall pot core design shown in FIG. 7 is that the suspension elements attached to the upper portion of the voice coil bobbin need to be physically spaced away from the top of the pot core so that the underside of the suspension elements do not touch the top of the pot core during maximum excursions. An advantage of the present invention is that the suspension or spider are not affixed to the bobbin's interior surfaces or on the inside of the coil former, but instead are attached to the bobbin's exterior and, as a result, will cannot interfere with the top of the pole piece.

A part of the diaphragm known as the "dust cap" is attached to the diaphragm above the pole piece but this part is easily spaced away from the top of the pole piece to allow sufficient clearance for maximum required displacement.

In conventional designs, it is a common practice to make the gap between the inside diameter of the bobbin and the outside diameter of the pole tip (for pot core designs) or the pole piece (for pancake designs) smaller than that gap between the outside diameter of the voice coil and the inside diameter of the pot core (for pot core designs) or the front plate (for pancake designs). This is done to allow the voice coil assembly to expand physically as it heats. This conventional method requires more space on the outside of the coil so that as the voice coil assembly increases in diameter, it will not come into contact with the inside diameter of the pot core or front plate.

If the voice coil wire touches the pot core or front plate it will produce an audible rub, or distortion, and frequently will produce a catastrophic failure of the loudspeaker by producing an electrical short circuit or open circuit.

The conventional design geometry allows the voice coil to expand toward the pot core or front plate, and so as the prior art voice coil becomes hotter, it expands toward possible contact with the front plate.

In the preferred embodiment of the motor structure, the front plate has a selected thickness and vertical extent for its inner peripheral sidewall, facing the magnetic gap, and, ignoring the fringe effects of the magnetic field, the front plate thickness is substantially equal to the height of the magnetic gap. The voice coil is wound solely on the interior surface of the bobbin or former and has a top-to bottom voice coil height (or length, along the coil's central axis) that is much greater than the magnetic gap's height and the front plate's thickness; preferably the voice coil's height is double the gap's height or more. In accordance with the present invention, when the foregoing geometry is provided and when, in addition, the motor's pole piece projects forwardly well beyond the voice coil's forwardmost edge (when at rest), then the driver will provide surprisingly accurate and linear reproduction while maintaining low coil temperatures and will also provide long trouble-free service because the voice coil never rubs against the front plate or any other structure likely to cause catastrophic failure. The optimum relationships are described in greater detail below.

The unique geometry of the present invention allows the voice coil to expand away from the nearest non-reciprocating structure, the pole piece or pole tip, rather than toward it. This geometry can only allow any expansion and subsequent rubbing of the voice coil bobbin between the bobbin's smooth outer surface and the inside diameter surface of the front plate, leaving the delicate coil windings untouched. This arrangement will act to prevent catastrophic electrical failures from occurring, since the voice coil's conductors, when heated, actually move farther from the inside diameter of the pot core or front plate.

The driver motor structure of the present invention provides a unique and cost effective method to provide increased thermal conduction from a loudspeaker voice coil. The prior art motors described above each are associated with specific short-comings, while the Inside Only voice coil structure of the present invention offers high thermal conductivity for the entire vertical voice coil height. It can easily provide for cooling regardless of voice coil physical displacement. It can equal the cooling provided by pot core designs but has the advantage of being able to accommodate larger permanent magnet cross sections, and hence physical volumes to provide for higher permanent magnetic fields in the magnetic gap. The inside only voice coil configuration of the present invention does not require the spacing of the loudspeaker suspension elements to be spaced farther away from the top of the voice coil to accommodate the increased height of the pot core as is the case with pot core designs.

The Inside only configuration of the present invention provides superior protection from catastrophic rubs and electrical short and open circuit failures while providing excellent heat transfer in a magnetically efficient and economical adaptation of the pancake style permanent magnet motor.

The above and still further objects, features and advantages of the present invention will become apparent upon consideration of the following detailed description of a specific embodiment thereof, particularly when taken in conjunction with the accompanying drawings, wherein like reference numerals in the various Figs are utilized to designate like components.

BRIEF DESCRIPTION OF THE DRAWINGS

FIG. 16*a* is an enlarged detailed top or plan view of the pole piece/back plate assembly from the motor of FIG. 12, in accordance with the present invention.

FIG. 16*b* is an enlarged detailed cross section, in elevation, of the pole piece/back plate assembly from motor of FIG. 12, in accordance with the present invention.

Figure 1A:
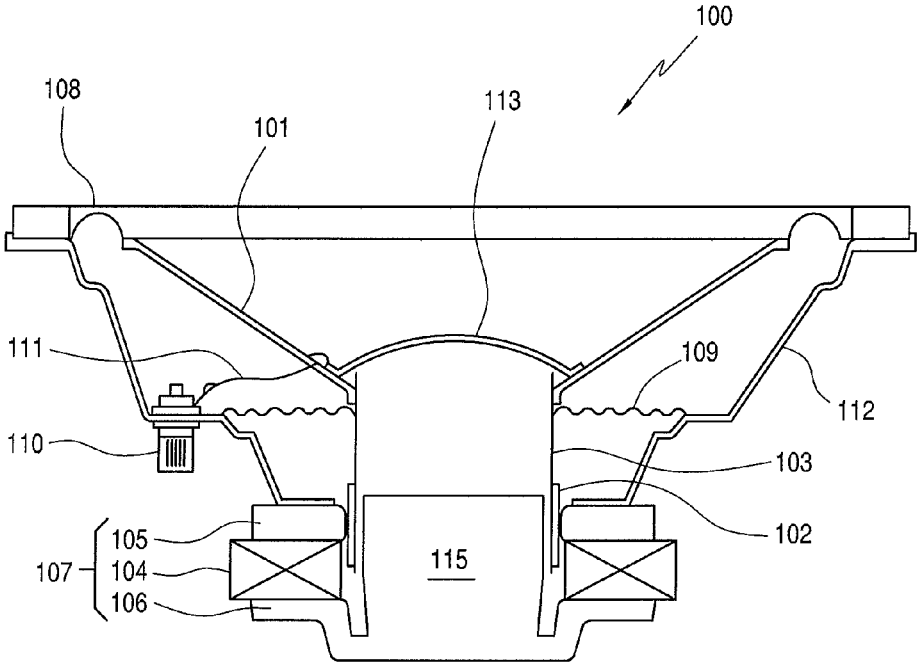
FIG. 1A PRIOR ART
FIG. 1*a* schematically illustrates a conventional loudspeaker or transducer and its motor structure.
Figure 1B:
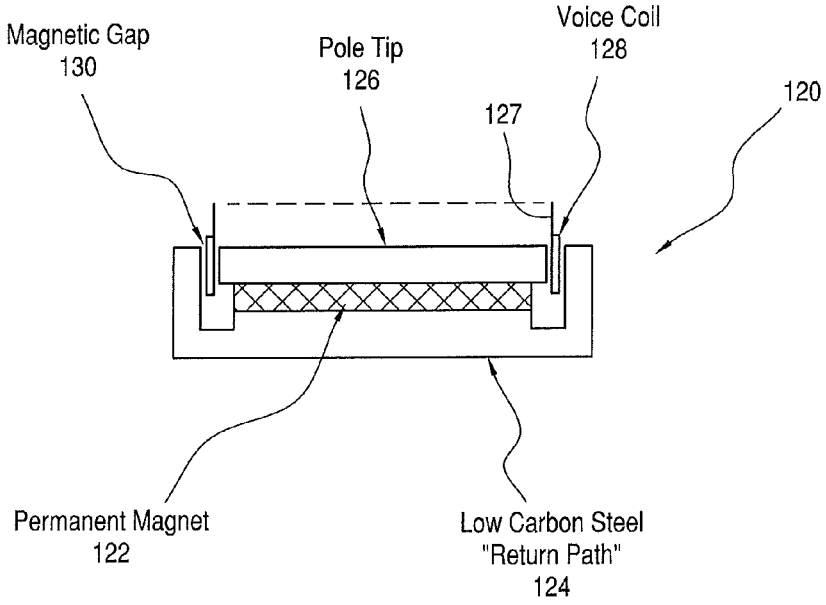
FIG. 1B PRIOR ART
FIG. 1B schematically illustrates a conventional pot core style motor.
Figure 2:
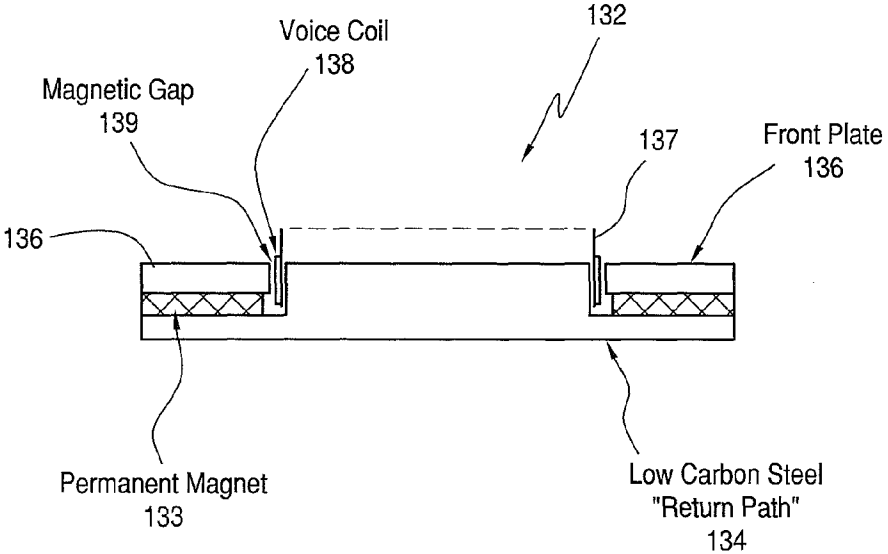
FIG. 2 PRIOR ART
FIG. 2 schematically illustrates a conventional pancake style motor.
Figure 3:
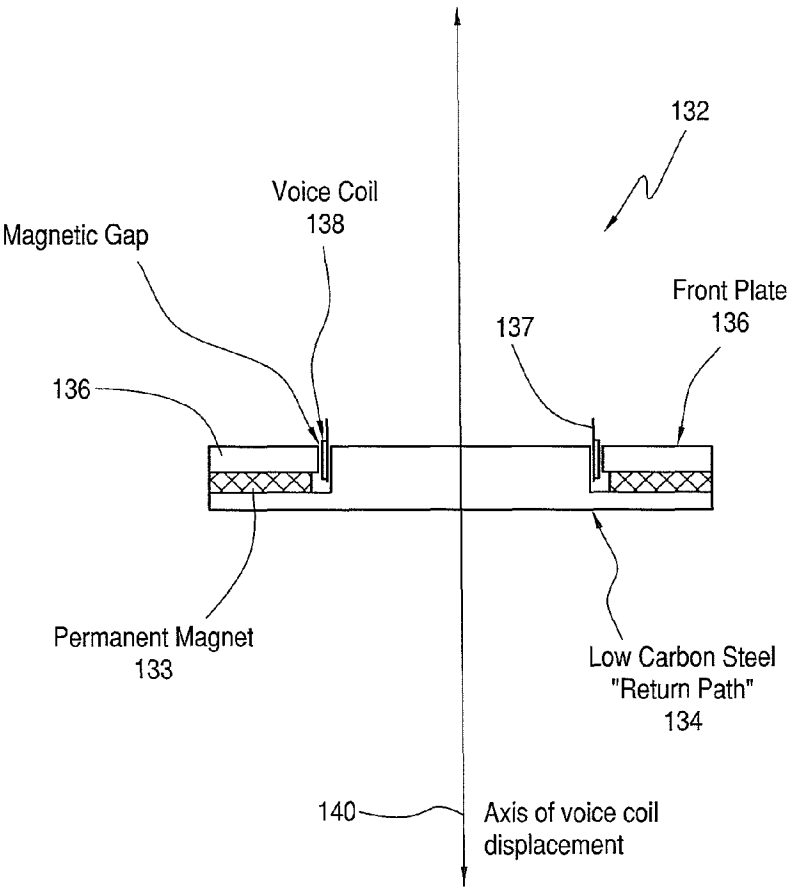
FIG. 3 PRIOR ART
FIG. 3 schematically illustrates a conventional pancake style motor's axial orientation.
Figures 4A, 4B, 4C:
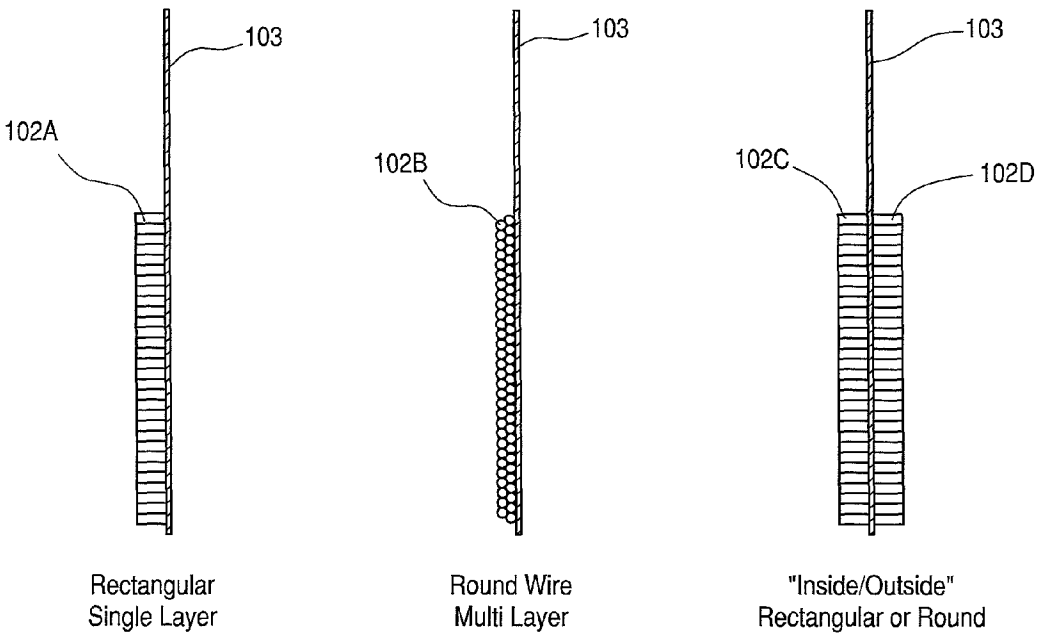
FIG. 4A PRIOR ART
FIG. 4B PRIOR ART
FIG. 4C PRIOR ART
FIGS. 4*a*-4*c* illustrate cross sections of three conventional voice coils on a former.
Figures 5A, 5B:
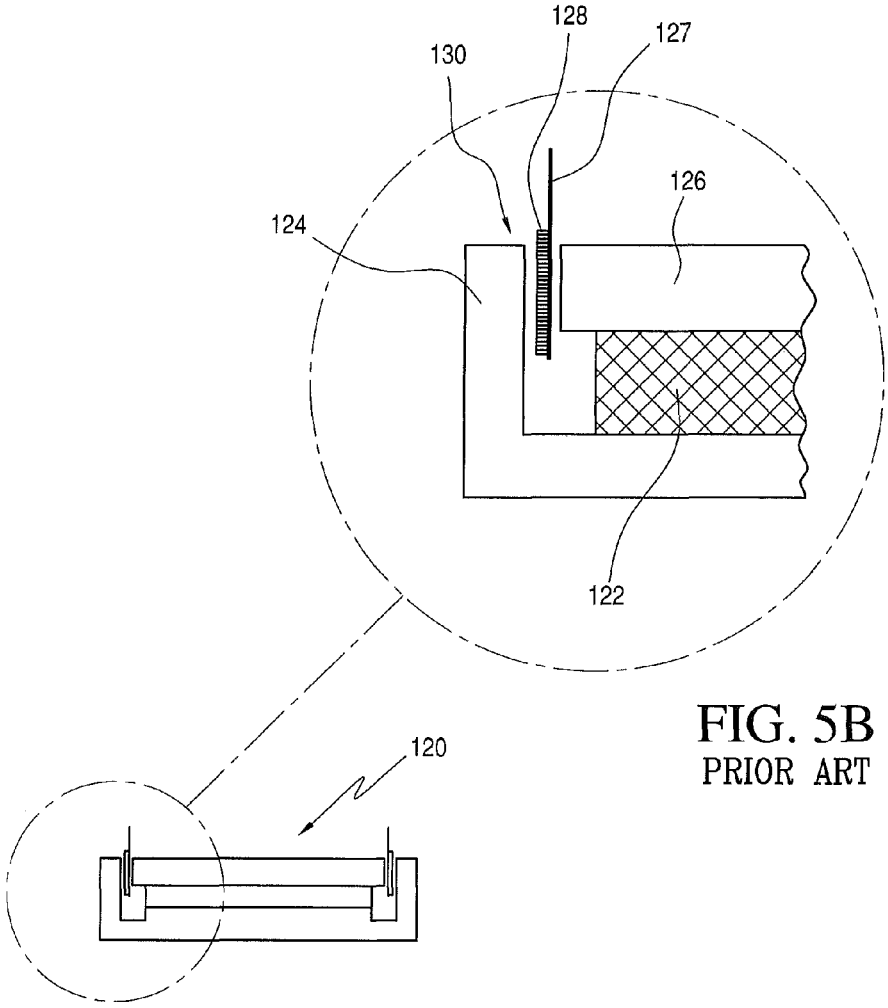
FIG. 5B PRIOR ART
FIG. 5A PRIOR ART
FIGS. 5*a* and 5*b* schematically illustrates a conventional motor, showing details of the magnetic gap.
Figure 6:
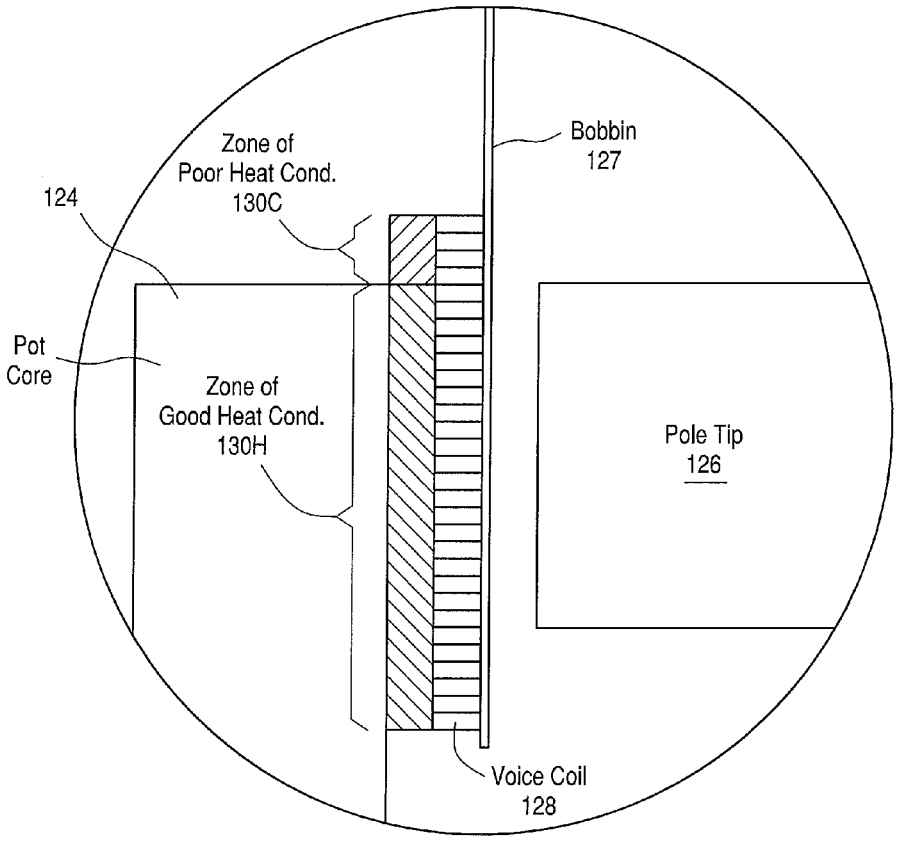
FIG. 6 PRIOR ART
FIG. 6 schematically illustrates a conventional motor's thermal performance.

DESCRIPTION OF THE PREFERRED EMBODIMENTS AND BEST MODES FOR CARRYING OUT THE INVENTION

Before explaining exemplary embodiments and methods of the present invention in detail, it is to be understood that the invention is not limited in its application to the details of construction and to the arrangements of the components set forth in the following description or illustrated in FIGS. 11-16B. The invention is capable of other embodiments and of being practiced and carried out in various ways. Also, it is to be understood that the phraseology and terminology employed herein are for the purpose of description and should not be regarded as limiting.

Turning now to FIGS. 11-16B, in accordance with the method and structure of the present invention, a new loudspeaker 180 has a motor structure 200 including an electrically conductive voice coil 220 made of conductor wound solely and entirely within a (preferably) cylindrical bobbin or former 210 to provide a voice coil assembly having a smooth, tough resilient cylindrical exterior sidewall surface that is ideally well suited to be positioned very close to driver motor's thermally conductive front plate 206, near the front plate's inwardly facing surface which defines the magnetic gap. The voice coil's conductor 220 (e.g., wire) is wound only within the voice coil bobbin's cylindrical interior or inside surface and so can never rub against or be interfered with by the front plate 206, even when expanding due to thermal expansion.

Figure 12:
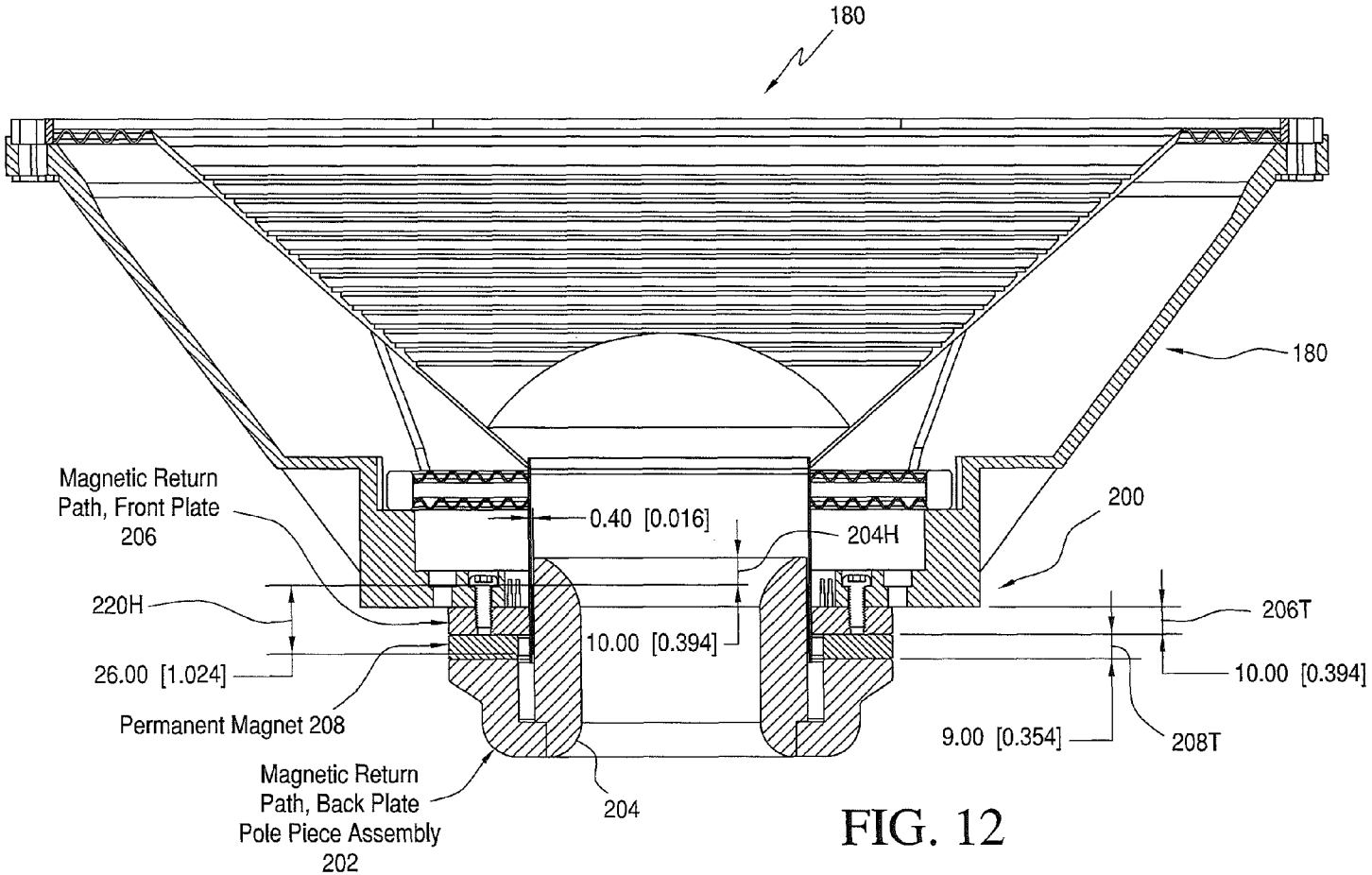
FIG. 12 is a partial cross section view, in elevation, of a preferred embodiment of a loudspeaker incorporating the motor of the present invention.

Referred to as "inside only" technology, this novel approach offers the same level of heat transfer as the pot core design but allows permanent magnet 208 to be configured within area and volume optimized to generate high permanent magnetic field strength with a specially adapted pancake style motor 200 (e.g., as shown in FIG. 12).

Figure 7:
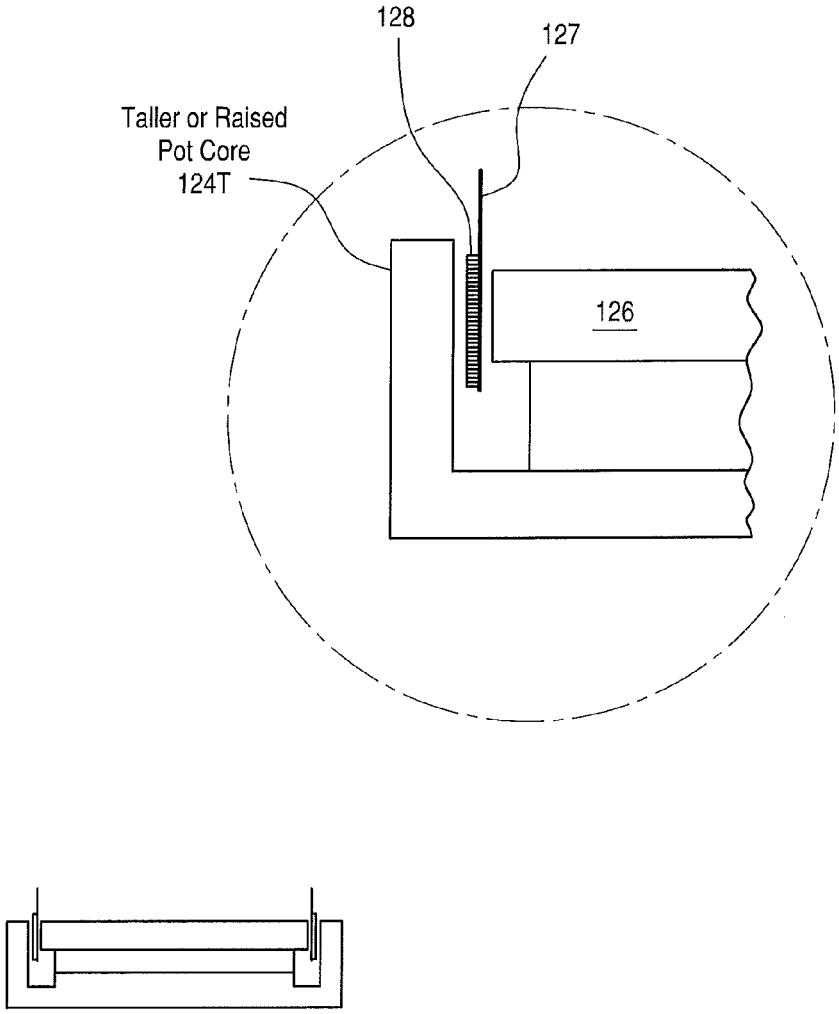
FIG. 7 PRIOR ART
FIG. 7 schematically illustrates another conventional motor having a raised pot core.
Figure 8:
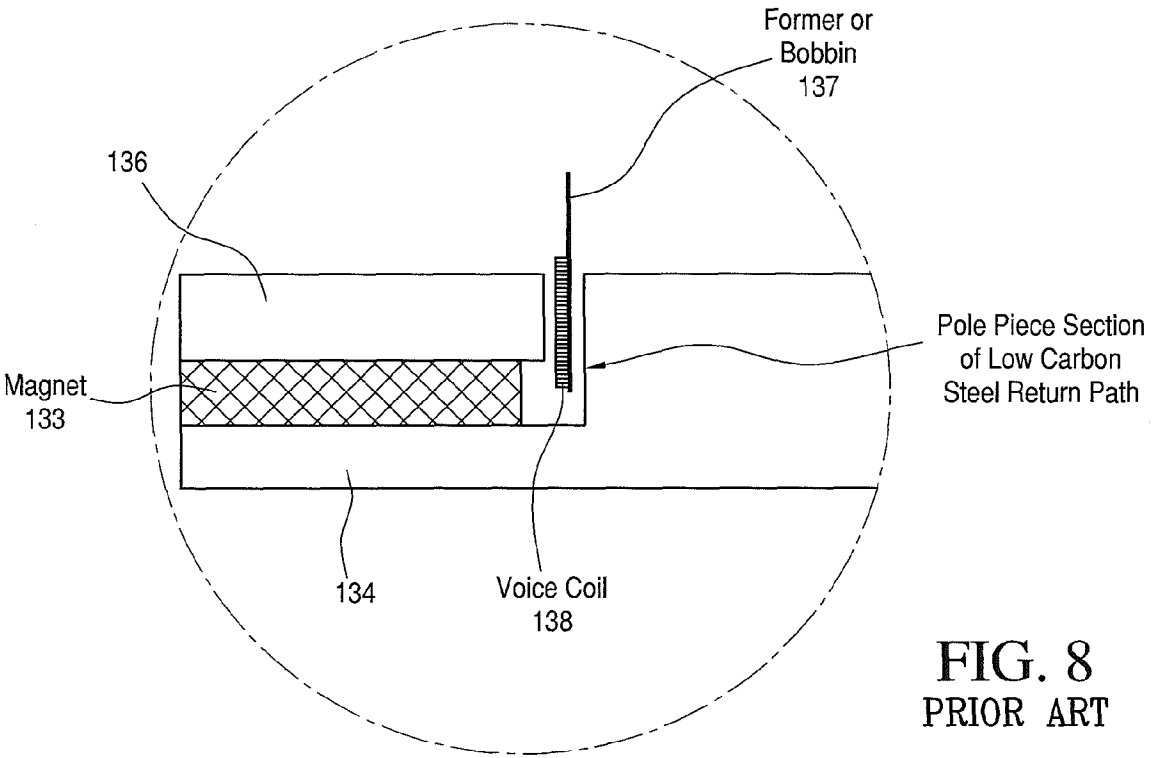
FIG. 8 PRIOR ART
FIG. 8 schematically illustrates another conventional pancake motor's magnetic gap.
Figure 9B:
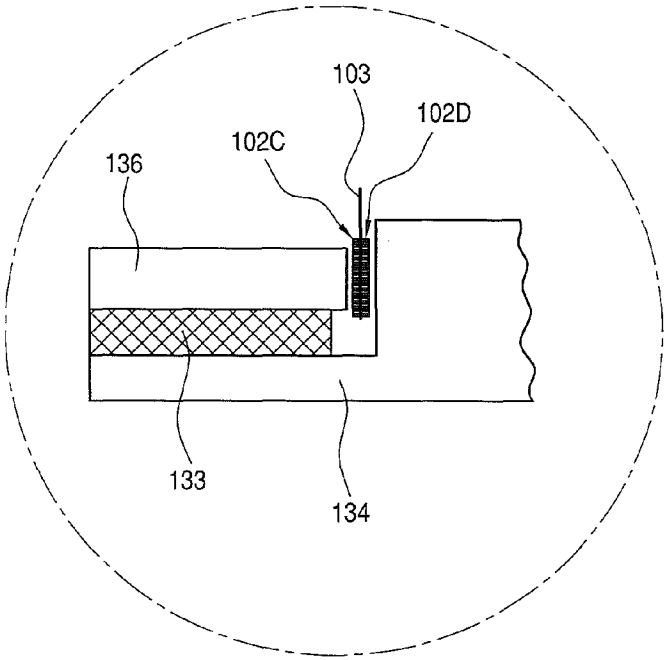
FIG. 9B PRIOR ART
FIGS. 9*a* and 9*b* schematically illustrates inside/outside voice coils in gaps of a conventional pot core motor and a conventional pancake style motor.
Figure 9A:
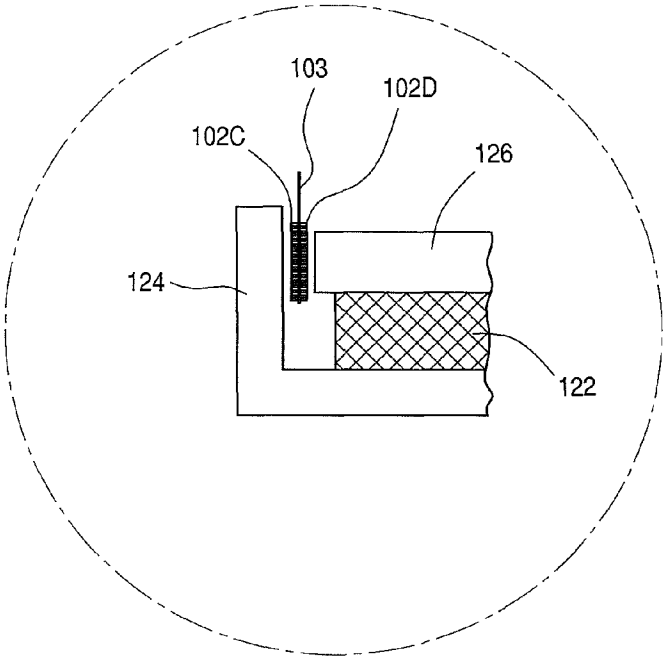
FIG. 9A PRIOR ART
Figure 10:
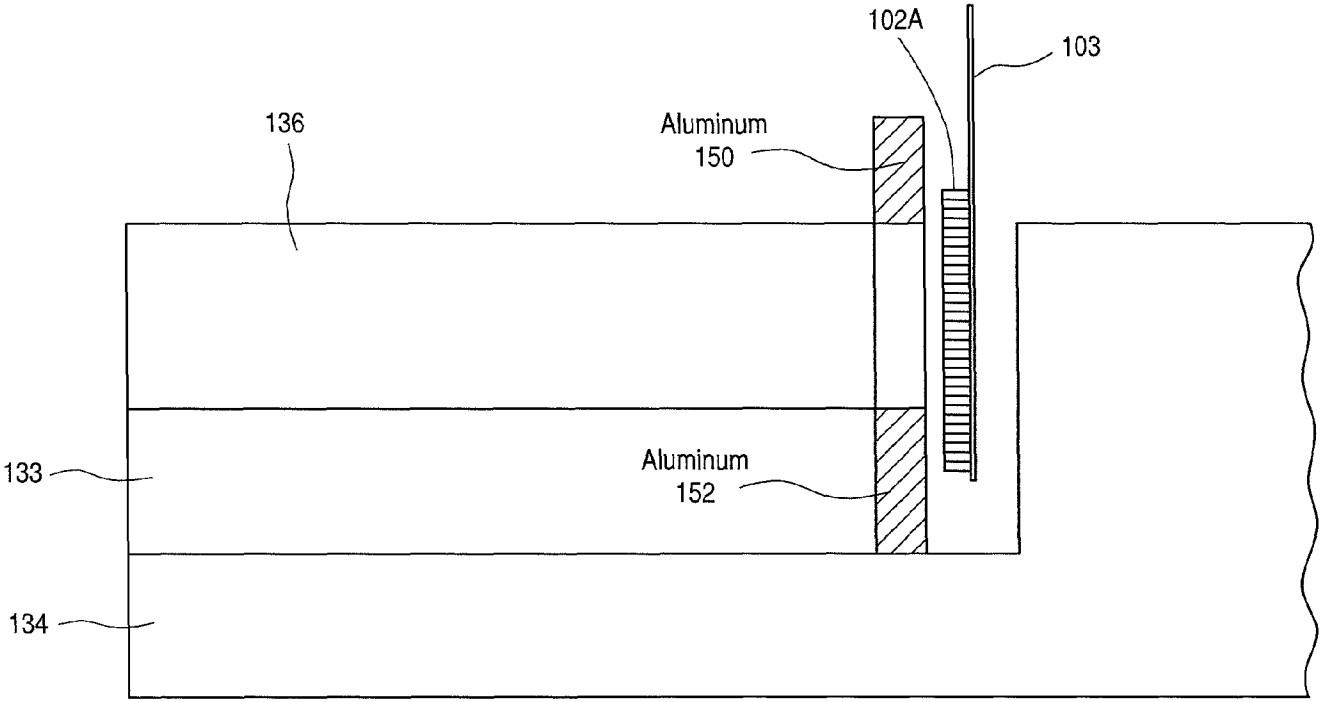
FIG. 10 PRIOR ART
FIG. 10 schematically illustrates a conventional pancake style motor with added heat sinks. p
Figure 11:
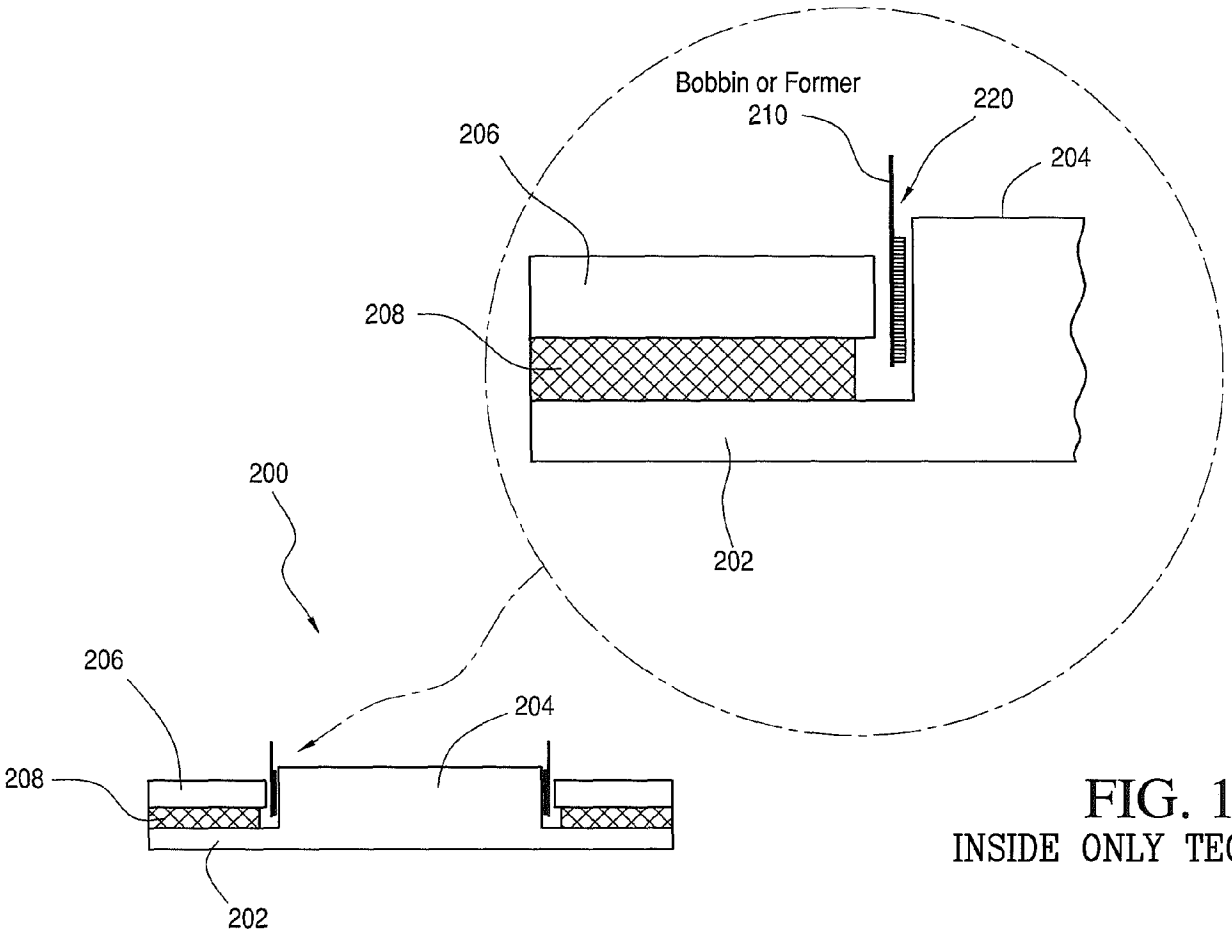
FIG. 11 shows a cross section view and an enlarged detail view illustrating the inside-only voice coil and motor of the present invention.
Figure 13:
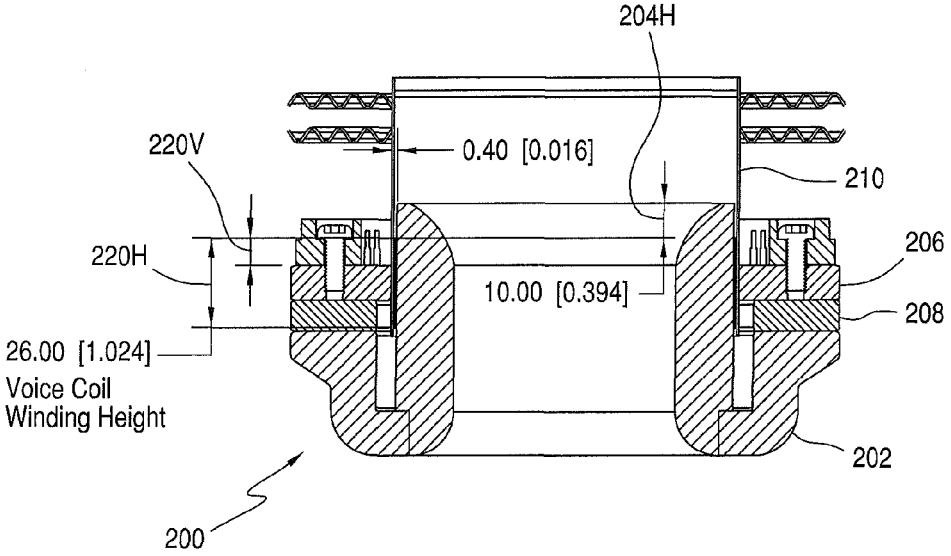
FIG. 13 is an enlarged detailed partial cross section, in elevation, of the motor of FIG. 12, in accordance with the present invention.
Figure 14:
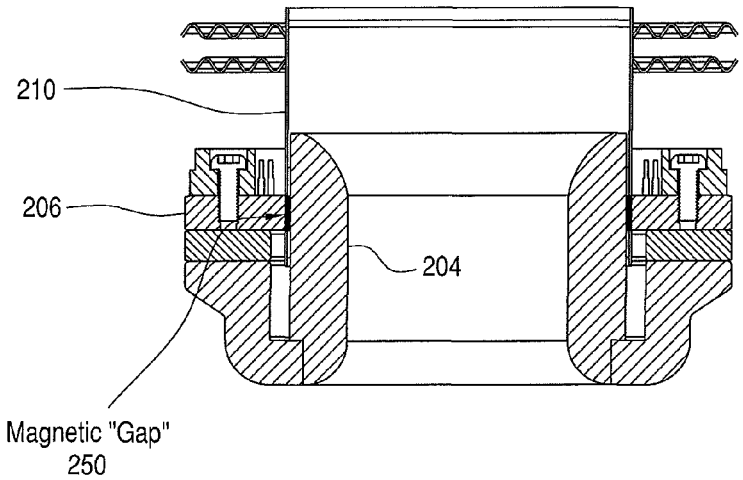
FIG. 14 is an enlarged detailed partial cross section, in elevation, of the motor of FIG. 12, highlighting the magnetic gap, in accordance with the present invention.

Motor structure 200 has voice coil 220 wound solely on the inside of bobbin 210 proximate the forwardly projecting pole piece 204. As best seen in FIGS. 12-14, pole piece 204 defines a tall tubular or cylindrical low carbon steel magnetic return path that is specially configured to extend forward or toward the cone or diaphragm, providing a central pole piece that projects along the central axis to a greater extent than in the prior art. The central or axial pole piece's height, in a preferred embodiment, will always be higher than the maximum physical displacement, or excursion, of the forward edge for voice coil 220, when driven to a maximum linear excursion, thereby providing good thermal transfer from voice coil 220 to the pole piece 204 at all times, regardless of the voice coil's displacement or excursion. The geometry of the present invention does not alter the permanent magnet gap's volume or symmetry. A disadvantage of the tall pot core design shown in FIG. 7 is that the suspension elements attached to the upper portion of the voice coil bobbin need to be physically spaced away from the top of the pot core so that the underside of the suspension elements do not touch the top of the pot core during maximum excursions. An advantage of loudspeaker 180 is that the suspension or spider are not affixed to the bobbin's interior surfaces or on the inside of coil former 210, but instead are attached to the bobbin's exterior and, as a result, will not interfere with the top or forward end of pole piece 204.

That part of the diaphragm known as the "dust cap" is preferably attached to the diaphragm above the pole piece but this part is easily spaced away from the top of the pole piece to allow sufficient clearance for maximum required displacement.

In conventional designs, it is a common practice to make the gap between the inside diameter of the bobbin and the outside diameter of the pole tip (for pot core designs) or the pole piece (for pancake designs) smaller than that gap between the outside diameter of the voice coil and the inside diameter of the pot core (for pot core designs) or the front plate (for pancake designs). This is done to allow the voice coil assembly to expand physically as it heats. This conventional method requires more space on the outside of the coil so that as the voice coil assembly increases in diameter, it will not come into contact with the inside diameter of the pot core or front plate, thereby diminishing magnetic efficiency. As noted above, if the voice coil wire touches the pot core or front plate it will produce an audible rub, or distortion, and frequently will produce a catastrophic failure of the loudspeaker by producing an electrical short circuit or open circuit. The conventional design geometry allows the voice coil to expand toward the pot core or front plate, and so as the prior art voice coil becomes hotter, it expands toward possible contact with the front plate.

Figure 15:
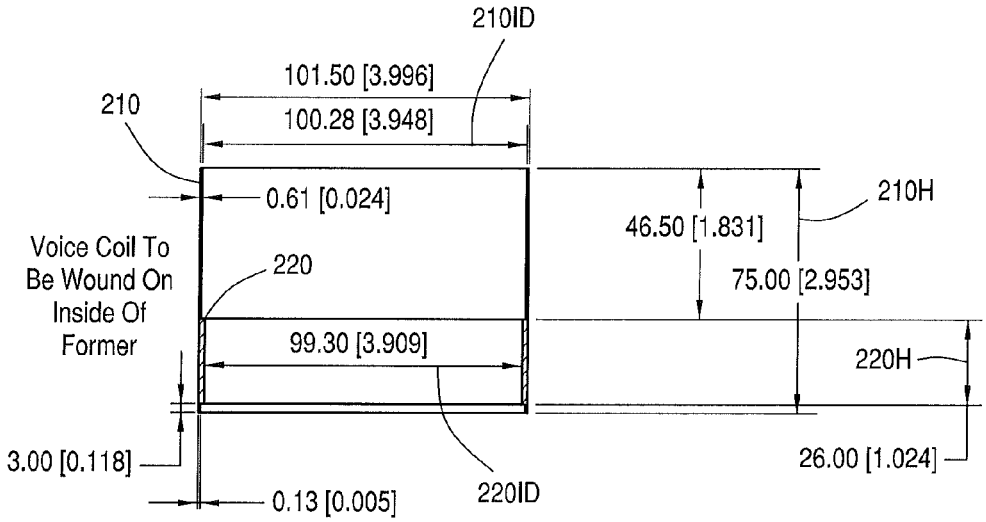
FIG. 15 is an enlarged detailed partial cross section, in elevation, of the voice coil assembly from motor of FIG. 12, in accordance with the present invention.

In the preferred embodiment of the motor structure shown in FIGS. 12-16B, front plate 206 has a selected thickness 206T (e.g., 10 mm) which defines the vertical extent for its inner peripheral sidewall, facing the magnetic gap (see FIG. 14), and, ignoring the fringe effects of the magnetic field, the front plate thickness 206T is substantially equal to the height of the magnetic gap. Voice coil 220 is wound solely on the interior surface of bobbin or former 210 and has a top-to bottom voice coil winding height 220H (or length, along the coil's central axis, as shown in FIG. 15) that is "overhung" or much greater than the magnetic gap's height and the front plate's thickness 206T. In the exemplary woofer 180 the voice coil winding height 220H (here, 26 mm) is more than double the gap's height (206T, 10 mm).

Significantly, the distal or forwardmost edge of the pole piece 204 extends a selected distance 204H (e.g., 10 mm) beyond the forwardmost edge of the voice coil windings and the overhung voice coil windings 220, when at rest, project forwardly by a symmetrical overhang height 220V (e.g., 8 mm) beyond the front edge of the front plate 206.

The applicant has discovered that the optimum relationships can be described in terms of these dimensions in an equation. Identifying front plate thickness or gap height, 206T as "$H_G$", voice coil winding height 220H as "$H_{VC}$", the symmetrical overhang height 220V as "$H_O$", and the pole piece forward projection distance 204H as "$H_P$", the motor structure of the present invention preferably conforms to the following:

$$(H_{VC}-H_G)/2=H_O \tag{4}$$

and $$H_O \text{ must be less than or equal to } H_P \tag{5}$$

Meaning that the magnetic gap thickness 206T, voice coil length or height 220H and the geometry of the distally or forwardly projecting pole piece (for 204H) are all dictated by the principals of the present invention as set forth in equations 4 and 5.

Looking at FIGS. 12, 13 and 14, these relationships illustrated, and so during extreme excursions, the forward or distal edge of voice coil 220 is continuously and entirely covered by a portion of the pole piece's cooling exterior sidewall, and so low distortion, linear and cool operation are ensured. In the exemplary woofer 180 shown in FIGS. 12-14, equations 4 and 5 provide the following (in millimeters):

$$(26\text{ mm}-10\text{ mm})/2=8\text{ mm (for } H_O)$$

and 8 mm is less than 10 mm (for $H_P$, shown as 204H in FIGS. 12 and 13). Accordingly, for this loudspeaker's entire linear range of excursion (8 mm, in the forward, 'out' or distal direction, away from the magnet) voice coil 220 continuously sees the same cooling effect along the entire voice coil length 220H.

In accordance with the present invention, when the foregoing geometry is provided and when, in addition, the motor's pole piece 204 projects distally or forwardly well beyond the voice coil's forwardmost edge (when at rest, as shown in FIGS. 11-14), then driver 180 will provide surprisingly accurate and linear reproduction while maintaining acceptably low coil temperatures and will also provide long trouble-free service because voice coil 220 never rubs against front plate 206 or any other structure likely to cause catastrophic failure.

As best seen in FIG. 12, motor 200 has a cylindrical pole piece having a 64.5 mm diameter cooling lumen or vent through the center and is part of a back plate/pole piece assembly illustrated in FIGS. 16*a* and 16*b*. The magnetic gap's lateral span is defined by the pole piece's outside diameter 204OD (e.g., 98.5 mm) and the inside diameter of the front plate (e.g., 102.5 mm) which has an outside diameter of 160 mm. The pole piece, back plate and front plate are preferably made from 1010 steel or the like. The magnet 208 is preferably an annular ring made of SH37 neodymium iron boron having a thickness of 9 mm, an inside diameter of 110 mm and an outside diameter of 160 mm, and is plated with EDP or electroplate nickel.

The nominal clearance between the front plate's inside edge and the outer surface of a cold bobbin is about 0.4 mm or 10-20 thousandths of an inch, and the nominal clearance between the pole piece's outer circumferential surface and the surface of the cold voice coil windings is also about 0.4 mm or 10-20 thousandths of an inch. These close tolerances provide enhanced magnetic field strength and efficiency.

Turning now to FIGS. 11-16B, in accordance with the method and structure of the present invention, a new loudspeaker 180 has a motor structure 200 including an electrically conductive voice coil 220 made of conductor wound solely and entirely within a (preferably) cylindrical bobbin or former 210 to provide a voice coil assembly having a smooth, tough resilient cylindrical exterior sidewall surface that is ideally well suited to be positioned very close to driver motor's thermally conductive front plate 206, near the front plate's inwardly facing surface which defines the magnetic gap. Front plate 206, for purposes of nomenclature, may also be referred to as magnetic gap defining plate 206, since it defines the perimeter of the annular magnetic gap which is also bounded by the cylindrical surface of pole piece 204. The voice coil's conductor 220 (e.g., wire) is wound only within the voice coil bobbin's cylindrical interior or inside surface and so can never rub against or be interfered with by the front plate 206, even when expanding due to thermal expansion.

The unique geometry of motor 200 allows voice coil 220, when energized and getting hot, to expand away from the nearest non-reciprocating structure, the pole piece or pole tip (e.g., 204) rather than toward it. This geometry can only allow any expansion and subsequent rubbing of the voice coil bobbin between the bobbin's smooth outer surface and the inside diameter surface of the front plate, leaving the delicate coil windings untouched. This arrangement will act to prevent catastrophic electrical failures from occurring, since the voice coil's conductors, when heated, expand to move farther from the inside diameter of the pot core or front plate.

INDUSTRIAL APPLICABILITY

The driver motor structure of the present invention provides a unique and cost effective method to provide increased heat transfer from a loudspeaker voice coil. The prior art motors described above each are associated with specific short-comings, while the Inside Only voice coil structure of the present invention offers high thermal transmission for the entire vertical voice coil's height (e.g., 220H). It can easily provide for cooling regardless of voice coil physical displacement, equaling the cooling provided by pot core designs but having the advantage of being able to accommodate larger permanent magnet cross sections, and hence physical volumes to provide for higher permanent magnetic fields in the magnetic gap. The inside only voice coil configuration of the present invention does not require the spacing of the loudspeaker suspension elements to be spaced farther away from the top of the voice coil to accommodate the increased height of the pot core as is the case with pot core designs.

The Inside only configuration of the present invention provides superior protection from catastrophic rubs and electrical short and open circuit failures while providing excellent heat transfer in a magnetically efficient and economical adaptation of the pancake style permanent magnet motor.

Having described preferred embodiments of a new and improved method and apparatus, it is believed that other modifications, variations and changes will be suggested to those skilled in the art in view of the teachings set forth herein. It is therefore to be understood that all such variations, modifications and changes are believed to fall within the scope of the present invention as set forth in the claims.

What is claimed is:

1. A transducer motor structure for generating acoustic vibrations in response to an electrical audio signal, comprising:

a voice coil former having an open interior lumen with an inside surface adapted to carry a single conductive voice coil having first and second electrical connections; said voice coil former being configured to be driven in a linear excursion and drive a diaphragm;

wherein said single voice coil is carried entirely within said former's interior lumen and has a selected axial length or height;

a magnetic circuit comprising a permanent magnet configured to generate a permanent magnetic field, a pole piece having a central axis, a magnetic field return path, and a magnetic gap defining plate, wherein said pole piece, said return path and said magnetic gap defining plate are all configured to constrain lines of magnetic flux from said permanent magnetic field across a magnetic gap;

wherein said magnetic gap is annular and dimensioned to receive said voice coil former in coaxial alignment, such that said voice coil having said first and second electrical connections is immersed in the magnetic field in said magnetic gap;

wherein said pole piece projects into said former's lumen and is coaxially aligned with said voice coil former, such that said voice coil is constrained to move axially over said pole piece in response to an audio signal;

wherein said pole piece has an axial length projecting into said former's lumen that is greater than said voice coil's selected length; and wherein said magnetic gap defining plate is configured to define a magnetic gap having a selected thickness, said thickness being less than said voice coil's selected length.

2. The transducer motor structure of claim 1, wherein said magnetic gap defining plate thickness is nominally HG;

said voice coil winding length is nominally HVC;

said voice coil has a substantially symmetrical overhang, the symmetrical overhang height being nominally HO;

wherein said pole piece projects axially beyond said voice coil by a distance identified nominally as HP;

said motor structure being configured with $$(HVC-HG)/2=HO \text{ and}$$

wherein

HO is selected to be less than or equal to HP.

3. A loudspeaker having motor structure for generating acoustic vibrations in response to an electrical audio signal, comprising:

a diaphragm supported in a suspension for movement relative to a basket;

a voice coil former having a forward end attached to said diaphragm and an open interior lumen with an inside surface adapted to carry a single conductive voice coil having first and second electrical connections; said voice coil former being configured be driven in a linear excursion and to drive said diaphragm;

wherein said single voice coil having said first and second electrical connections is carried entirely within said former's interior lumen and has a selected axial length or height;

a magnetic circuit comprising a permanent magnet configured to generate a permanent magnetic field, a pole piece having a central axis, a magnetic field return path, and a magnetic gap defining plate, wherein said pole piece, said return path and said magnetic gap defining plate are all configured to constrain lines of magnetic flux from said permanent magnetic field across a magnetic gap;

wherein said magnetic gap is annular and dimensioned to receive said voice coil former in coaxial alignment, such that said voice coil is immersed in the magnetic field in said magnetic gap;

wherein said pole piece projects into said former's lumen and is coaxially aligned with said voice coil former, such that said voice coil is constrained to move axially over said pole piece in response to an audio signal;

wherein said pole piece has an axial length projecting into said former's lumen that is greater than said voice coil's selected length; and wherein said magnetic gap defining plate is configured to define a magnetic gap having a selected thickness, said thickness being less than said voice coil's selected length.

4. The loudspeaker of claim 3, wherein said magnetic gap defining plate thickness is nominally HG;

said voice coil winding length is nominally HVC;

said voice coil has a substantially symmetrical overhang, the symmetrical overhang height being nominally HO;

wherein said pole piece projects axially beyond said voice coil by a distance identified nominally as HP;

said motor structure being configured with $$(HVC-HG)/2=HO \text{ and}$$

wherein

HO is selected to be less than or equal to HP.

5. A method for maintaining the operating temperature of a voice coil in a loudspeaker, comprising:

making a voice coil former having an open interior lumen with an inside surface adapted to carry a single conductive voice coil having first and second electrical connections; said voice coil former being configured to be driven in a linear excursion and drive a diaphragm;

winding said single voice coil having said first and second electrical connections entirely within said former's interior lumen so said voice coil has a selected axial length or height;

configuring a magnetic circuit comprising a permanent magnet configured to generate a permanent magnetic field, a pole piece having a central axis, a magnetic field return path, and a magnetic gap defining plate, wherein said pole piece, said return path and said magnetic gap defining plate are all configured to constrain lines of magnetic flux from said permanent magnetic field across a magnetic gap;

wherein said magnetic gap is annular and dimensioned to receive said voice coil former in coaxial alignment, such that said voice coil is immersed in the magnetic field in said magnetic gap;

wherein said pole piece projects into said former's lumen and is coaxially aligned with said voice coil former, such that said voice coil is constrained to move axially over said pole piece in response to an audio signal;

wherein said pole piece has an axial length projecting into said former's lumen that is greater than said voice coil's selected length; and wherein said magnetic gap defining plate is configured to define a magnetic gap having a selected thickness, said thickness being less than said voice coil's selected length.

6. The method of claim 5, further comprising:

defining a magnetic gap defining plate thickness to be nominally HG;

winding said voice coil so said winding length is nominally HVC;

selecting said voice coil to have a substantially symmetrical overhang, the symmetrical overhang height being nominally HO;

configuring said pole piece to project axially beyond said voice coil by a distance identified nominally as HP;

configuring said motor structure with $$(HVC-HG)/2=HO \text{ and}$$

wherein

HO is selected to be less than or equal to HP.

* * * * *